United States Patent [19]

Shuttleworth et al.

[11] Patent Number: 4,861,700

[45] Date of Patent: Aug. 29, 1989

[54] PHOTOGRAPHIC ELEMENT CONTAINING YELLOW FILTER DYES HAVING TRICYANOVINYL GROUPS

[75] Inventors: Leslie Shuttleworth, Webster; Paul B. Merkel, Rochester, both of N.Y.

[73] Assignee: Eastman Kodak Company, Rochester, N.Y.

[21] Appl. No.: 122,829

[22] Filed: Nov. 19, 1987

[51] Int. Cl.[4] ..... G03C 1/84

[52] U.S. Cl. ..... 430/517; 430/343; 430/522

[58] Field of Search ..... 430/517, 522, 343

[56] References Cited

U.S. PATENT DOCUMENTS

| | | | |
|---|---|---|---|
| 2,725,378 | 11/1955 | Rees | 260/240.7 |
| 2,928,831 | 3/1960 | Surrey | 260/247.5 |
| 3,040,056 | 6/1962 | Williams | 260/326.5 |
| 3,040,083 | 6/1962 | Wiley | 260/465 |
| 3,100,133 | 8/1963 | Risiner et al. | 8/55 |
| 3,721,552 | 3/1973 | Tellier et al. | 96/1.5 |
| 4,420,555 | 12/1983 | Krueger et al. | 430/507 |

*Primary Examiner*—Jack P. Brammer

*Attorney, Agent, or Firm*—Paul L. Marshall

[57] ABSTRACT

Photographic elements comprising filter dyes of the formula:

wherein A is a pyrrole or indole nucleus, with the tricyanovinyl radical occupying the 2 or 3 position of the nucleus.

7 Claims, No Drawings

PHOTOGRAPHIC ELEMENT CONTAINING YELLOW FILTER DYES HAVING TRICYANOVINYL GROUPS

FIELD OF THE INVENTION

This invention relates to dyes, particularly dyes useful as filter dyes, especially in photographic elements.

BACKGROUND OF THE INVENTION

Photographic materials often contain layers sensitized to different regions of the spectrum, such as red, blue, green, ultraviolet, infrared, X-ray, to name a few. A typical color photographic element contains a layer sensitized to each of the three primary regions of the visible spectrum, i.e., blue, green, and red. Silver halide used in these materials has an intrinsic sensitivity to blue light. Increased sensitivity to blue light, along with sensitivity to green light or red light, is imparted through the use of various sensitizing dyes adsorbed to the silver halide grains. Sensitized silver halide retains its intrinsic sensitivity to blue light.

If, prior to processing, blue light reaches a layer containing silver halide that has been sensitized to a region of the spectrum other than blue, the silver halide grains exposed to the blue light, by virtue of their intrinsic sensitivity to blue light, would be rendered developable. This would result in a false rendition of the image information being recorded by the photographic element. It is therefore a common practice to include in the photographic element a material that filters blue light. This blue-absorbing material can be located anywhere in the element where it is desired to filter blue light. In a color photographic element that has layers sensitized to each of the primary colors, it is common to have the blue-sensitized layer closest to the exposure source and to interpose a blue-absorbing, or yellow, filter layer between the blue-sensitized layer and the green- and red-sensitized layers.

The material most commonly used as a blue-absorbing material in photographic elements is yellow colloidal silver, referred to in the art as Carey Lea silver. It absorbs blue light during exposure and is readily removed during processing, usually during the silver bleaching and fixing steps. Carey Lea silver, however, exhibits unwanted absorption in the green region of the spectrum. Also, silver can be an expensive component of a photographic element.

A number of yellow dye alternatives for Carey Lea silver have been suggested. These include dyes disclosed in U.S. Pat. Nos. 2,538,008, 2,538,009, and 4,420,555, and U.K. Pat. Nos. 695,873 and 760,739. Many of these dyes, although they exhibit the requisite absorption of blue light, also are subject to stain problems. Some dyes are not fully decolorized or removed during photographic processing, thus causing post-processing stain. Other dyes wander into other layers of the element, adversely affecting image quality. Still other dyes react before exposure with other components of the photographic element, such as color couplers, thus causing incubative stain. Therefore, it would be desirable to provide a filter dye for use in photographic elements that absorbs blue light, but does not absorb significant amounts of light in other regions of the spectrum, and exhibits neither incubative nor post-processing stain.

SUMMARY OF THE INVENTION

Photographic elements according to the invention comprise a support having thereon a layer comprising a dye of the formula:

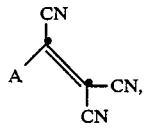

(I)

wherein A is a pyrrole or indole nucleus, with the tricyanovinyl radical occupying the 2 or 3 position of the nucleus.

The dyes of formula (I) absorb blue light without significant absorption beyond the blue portion of the spectrum. These dyes do not cause incubative stain in photographic elements and the elements are readily decolorized during photographic processing.

DETAILED DESCRIPTION OF THE INVENTION

Examples of useful dyes according to formula (I) are shown below. The pyrrole or indole ring may be substituted with, for example, groups such as alkyl, aryl, halogen, sulfonamido, acyl, formyl, or carboxylate.

1

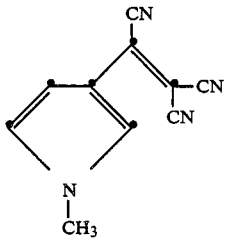

2

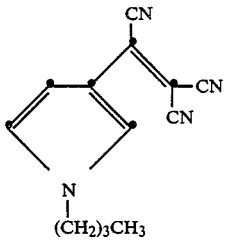

3

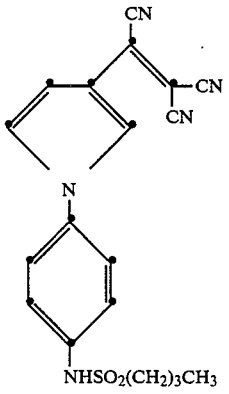

-continued
4
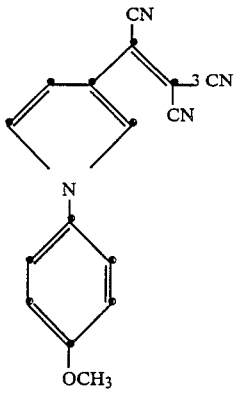
5
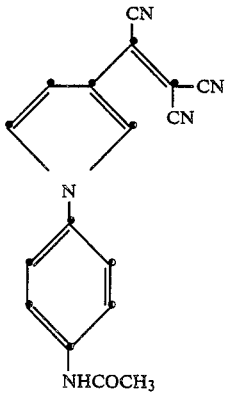
6
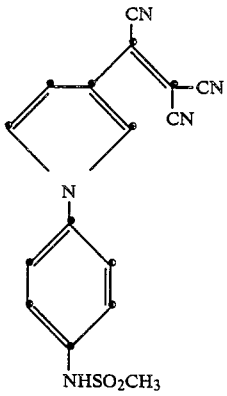
7
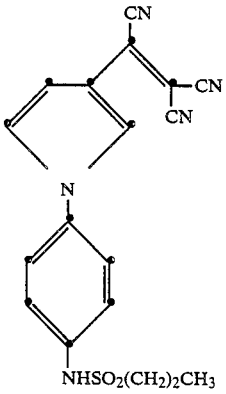
-continued
8
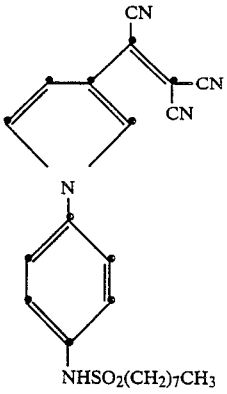
9
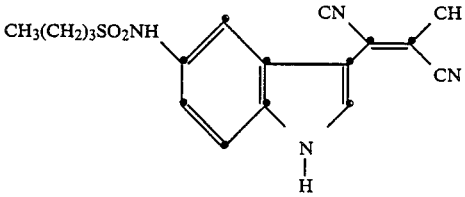
10
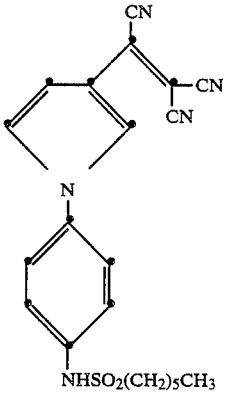
11
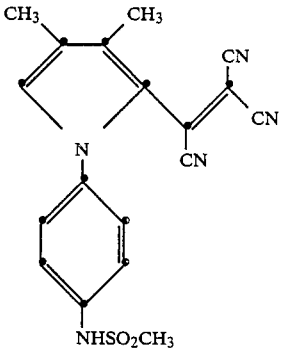
12
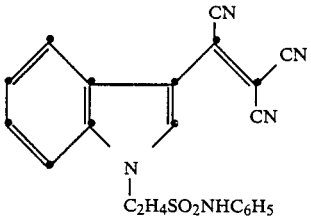

-continued
13
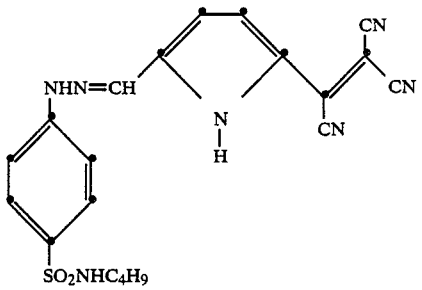
14
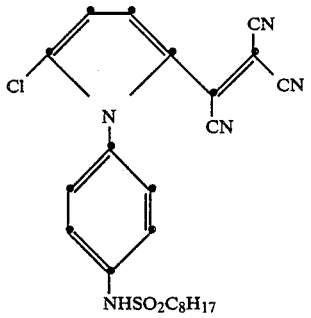
15
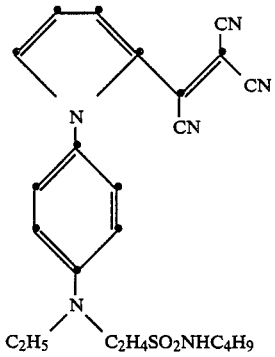
16
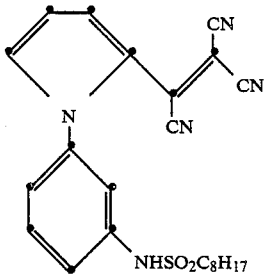
17
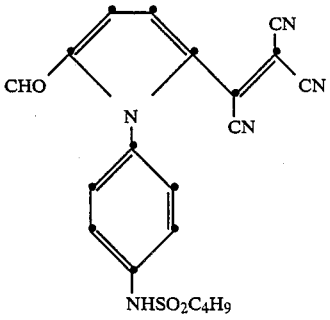
-continued
18
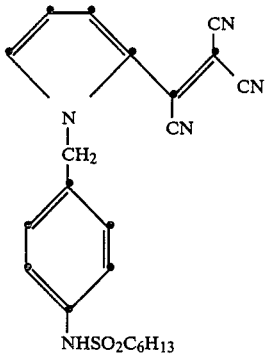
19
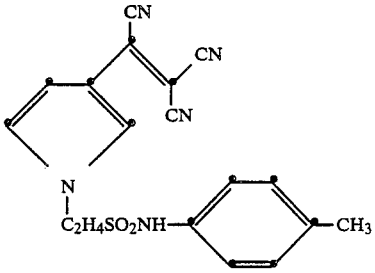
20
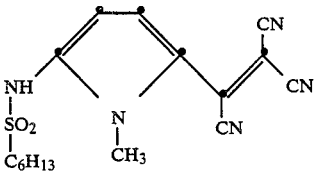
21
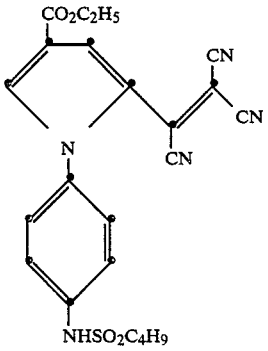
22
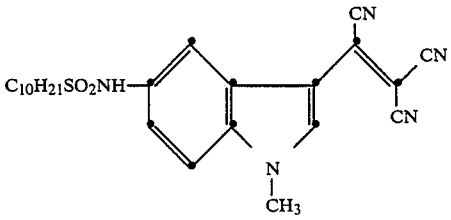

-continued

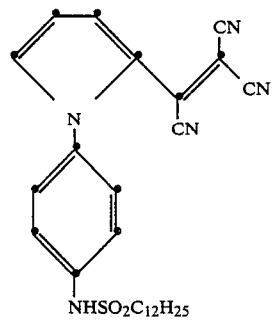

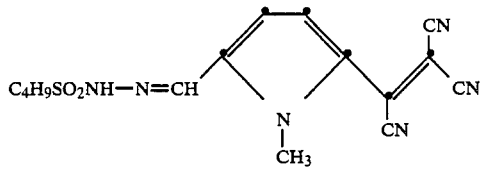

In a preferred embodiment, the dyes useful in the practice of invention include those of formula (II):

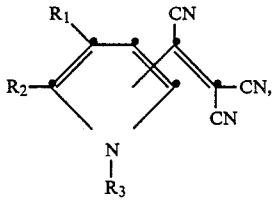

(II)

wherein $R_1$ and $R_2$ each independently represents H, alkyl or substituted alkyl of from 1 to 20 carbon atoms, or aryl or substituted aryl of from 6 to 20 carbon atoms, or together represent the atoms necessary to complete a 6-membered ring. $R_3$ is H, alkyl or substituted alkyl of from 1 to 20 carbon atoms, or aryl or substituted aryl of from 6 to 20 carbon atoms.

According to the formula (II), $R_1$, $R_2$, and $R_3$ can each represent H or alkyl or substituted alkyl of from 1 to 20 carbon atoms. Examples of alkyl groups include straight chain alkyls such as methyl, ethyl, propyl, butyl, pentyl, decyl, dodecyl, and so on, branched alkyl groups such as isopropyl, isobutyl, t-butyl, and the like. These alkyl groups may be substituted with any of a number of known substituents, such as sulfo, sulfato, sulfonamide, amido, amino, carboxyl, halogen, alkoxy, hydroxy, phenyl, and the like. The substituents may be located essentially anywhere on the alkyl group. The possible substituents are not limited to those exemplified, and one skilled in the art could easily choose from a number of substituted alkyl groups that would provide useful compounds according to formula (II).

$R_1$, $R_2$, and $R_3$ may also represent aryl or substituted aryl of from 6 to 20 carbon atoms. The substituents may be any of a number of known substituents for aryl groups, such as sulfo, sulfato, sulfonamide, amido, amino, carboxyl, halogen, alkoxy, hydroxy, alkyl, phenyl, alkyl, and the like. Additionally, the $R_3$ aryl group may have substituents that form fused ring systems with it, such as naphthyl. The substituents can be located essentially anywhere on the aryl group. The possible substituents are not limited to those exemplified, and one skilled in the art could easily choose from a number of substituted aryl groups that would provide useful compounds according to formula (II).

$R_1$ and $R_2$ may together represent the atoms necessary to complete a 6-membered ring, such as a phenyl ring. This ring may be substituted with any of a number of known substituents for such rings, such as sulfo, sulfato, sulfonamide, amido, amino, carboxyl, halogen, alkoxy, hydroxy, alkyl, phenyl, and the like. Additionally, the ring may have substituents that form fused ring systems with it, such as naphthyl. The substituents can be located essentially anywhere on the ring. The possible substituents are not limited to those exemplified, and one skilled in the art could easily choose from a number of substituted ring systems that would provide useful compounds according to formula (II).

The dyes useful in the invention can be prepared by well-known chemical synthetic techniques. A preferred synthesis involves reacting in solution an R-substituted pyrrole with tetracyanoethylene. A detailed description of the synthesis of compounds according to formula (I) can be found in the Examples below and in J. Am. Chem. Soc., 80, 2815 (1958).

The support of the element of the invention can be any of a number of well-known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further detail in *Research Disclosure,* December, 1978, Item 17643 [hereinafter referred to as Research Disclosure], Section XVII.

The radiation-sensitive layer of the element of the invention can contain any of the known radiation-sensitive materials, such as silver halide, diazo image-forming systems, light-sensitive tellurium-containing compounds, light-sensitive cobalt-containing compounds, and others described in, for example, J. Kosar, Light-Sensitive Systems: Chemistry and Application of Non-silver Halide Photographic Processes, J. Wiley & Sons, N.Y. (1965). Radiation-sensitive materials exhibiting sensitivity to blue light and especially those sensitive to blue light and at least some other wavelength of radiation are preferred, as the dyes accordig to the invention can be advantageously used to absorb some or all of the blue light.

Silver halide is especially preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure,* Section I. Also useful are tabular grain silver halide emulsions, as described in Research Disclosure, January 1983, Item 22534 and U.S. Pat. No. 4,425,426.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, styryls, or other known spectral sensitizers. Additional information on sensitization of silver halide is described in *Research Disclosure,* Sections I-IV.

The radiation-sensitive material and the dye of formula (I) are preferably dispersed in film forming polymeric vehicles and/or binders, as is well-known in the art. These include both naturally occuring and synthetic binders, such as gelatin and gelatin derivatives, polyvinyl alcohols, acrylamide polymers, polyvinylacetals, polyacrylates, and the like. Additional disclosure relating to useful vehicles and/or binders can be found in *Research Disclosure,* Section IX. In certain instances, especially where the dye is mobile (e.g., a dye with an $SO^0{}_3\ominus$substituent), it may be advantageous to use the dye in combination with a mordant, such as polyvinylimidazole or polyvinylpyridine, to aid in immobilizing the dye. The technology of mordanting dyes is well-known in the art, and is described in further detail in Jones et al U.S. Pat. Nos. 3,282,699 and Heseltine et al, 3,455,693 and 3,438,779.

In many instances, it is preferable to use a dispersing aid to help disperse the dye in the binder. Such dispersing aids are well-known in the art and include tricresyl phosphates, $n\text{-}C_{11}H_{23}CON(C_2H_5)_2$, or dibutyl phthalate. Also, the dye may be dispersed in the binder in the form of a solid particle dispersion, where small solid particles of the dye (having a mean diameter on the order of 10 $\mu$m or less and preferably 1 $\mu$m or less) are dispersed throughout the binder. Such dispersions are formed either by milling the dye in solid form until the desired particle size range is reached or by precipitating the dye directly in the form of a solid particle dispersion. Alternatively, the dye can be loaded into a latex polymer, either during or after polymerization, and the latex can be dispersed in a binder. Additional disclosure on loaded latexes can be found in Millikan U.S. Pat. No. 3,418,127.

The dye of formula (I) can be used in any photographic element where it is desirable to absorb light in the blue region of the spectrum. The dye could be used, for example, in a separate, non-light-sensitive filter layer or as an intergrain absorber in a radiation-sensitive layer. The dye is especially advantageously utilized in photographic elements having at least one silver halide layer that is sensitive to some wavelength of radiation other than blue light in addition to its intrinsic sensitivity to blue light. In such an instance, the dye can be used to reduce or prevent blue light from reaching this silver halide, thus assuring that the response of the silver halide will be to the radiation to which it is sensitized rather than from its intrinsic sensitivity to blue light. The dye of formula (I) is preferably present in a layer of the photographic element in an amount of from 0.01 to 1 $g/m^2$ and more preferably in an amount of from 0.05 to 0.5 $g/m^2$.

Although the dye of formula (I) can be utilized in any photographic element where it is desired to absorb blue light, the dye is especially advantageously utilized in photographic elements having at least one silver halide layer that is sensitive to some wavelength of radiation other than blue light, e.g., a color photographic element. Color photographic elements generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art and are further described in *Research Disclosure,* Section VII.

The element of the invention can also include any of a number of other well-known additives and layers, as described in *Research Disclosure.* These include, for example, optical brighteners, antifoggants, image stabilizers, light-absorbing materials such as filter layers or intergrain absorbers, light-scattering materials, gelatin hardeners, coating aids and various surfactants, overcoat layers, interlayers and barrier layers, antistatic layers, plasticizers and lubricants, matting agents, development inhibitor-releasing couplers, bleach accelerator-releasing couplers, and other additives and layers known in the art.

In a preferred embodiment of the invention, the dye of formula (I) is in a layer that is positioned between two light-sensitive silver halide layers, at least one of which is sensitive to at least one region of the spectrum other than blue. Such an element can be, for example, a color photographic element having a blue-sensitive layer, a green-sensitive layer, and a red-sensitive layer. In such an element, the layer containing the dye of formula (I), is preferably a yellow filter layer positioned between the blue-sensitive layer and all of the green- and red-sensitive layers, although it is possible for certain applications to have some of the red and/or green layers closer to the blue-sensitive layer than the yellow filter layer. One such alternative arrangement is described in U.S. Pat. No. 4,129,446, where a yellow filter layer is positioned between pairs of green- and red-sensitive emulsion layers so that at least some blue light reaches the faster green- and red-sensitive layers before striking the yellow filter layer. Other alternative arrangements are described in U.S. Pat. Nos. 3,658,536, 3,990,898, 4,157,917, and 4,165,236.

The photographic elements of the invention, when exposed, can be processed to yield an image. During processing, the dye of formula (I) will generally be decolorized and/or removed. Following processing, the dye of the invention should contribute less than 0.05 density unit, and preferably less than 0.02 density unit to the transmission D-max in the visible region in the minimum density areas of the exposed and processed element.

Processing can be by any type of known photographic processing, as described in *Research Disclosure,* Sections XIX–XXIV, although it preferably includes a high pH (i.e., 9 or above) step utilizing an aqueous sulfite solution in order to maximize decolorization and removal of the dye. A negative image can be developed by color development with a chromogenic developing agent followed by bleaching and fixing. A positive image can be developed by first developing with a non-chromogenic developer, then uniformly fogging the element, and then developing with a chromogenic developer. If the material does not contain a color-forming coupler compound, dye images can be produced by incorporating a coupler in the developer solutions.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Examples:

EXAMPLE 1

Step 1 —Preparation of Dye 7

N-(4'-butanesulfonamidophenyl) pyrrole (13.8 g) was dissolved in 50 ml dimethylformamide and 6.5 g of tetracyanoethylene was added. The mixture was heated with steam for 60 minutes, cooled and added to water slowly. A sticky dark solid precipitated after about 60 minutes, and was filtered out and washed with water to yield 18.85 g of a yellow/green solid. This solid was slurried at 40°-50° C. for 30 minutes with 200 ml methanol and cooled to room temperature. The solid was then washed with a further 100 ml methanol. The methanol filtrate and wash solution were added to 900 ml water with stirring to form a yellowish-green emulsion. The emulsion was stirred for 30 minutes, after which 10 mg sodium chloride was added. Stirring was continued until a solid precipitated. The solid was filtered, washed with water, and dried to yield 10.1 g of crude Dye 7. This solid was recrystallized from methanol and a small amount of water to yield 8.9 g of Dye 7 (m.p.=135°-137° C., $\lambda$=427 nm (methanol), $\epsilon=2.06\times10^4$).

Step 2 - Preparation of Photographic Element

The dye from step 1 was coated in a multilayer photographic element having the following format:

| | |
|---|---|
| gelatin | (100 mg/ft$^2$) |
| gelatin | (140 mg/ft$^2$) |
| AgBrI | (90 mg/ft$^2$) |
| coupler A | (122 mg/ft$^2$) |
| dibutyl phthalate | (12 mg/ft$^2$) |
| gelatin | (50 mg/ft$^2$) |
| Dye 7 | (25 mg/ft$^2$) |
| tricresyl phosphates | (50 mg/ft$^2$) |
| gelatin | (50 mg/ft$^2$) |
| gelatin | (130 mg/ft$^2$) |
| AgBrI | (82 mg/ft$^2$) |
| coupler B | (65 mg/ft$^2$) |
| tricresyl phosphates | (32 mg/ft$^2$) |
| gelatin | (450 mg/ft$^2$) |
| cellulose acetate support | |

Coupler A

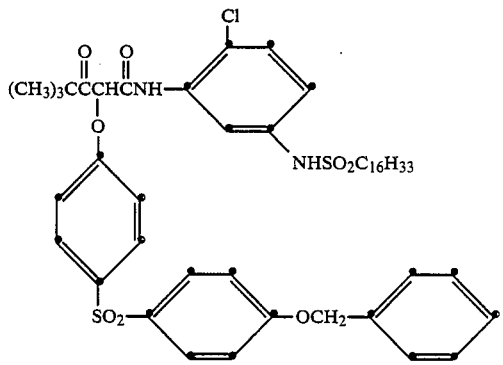

Coupler B

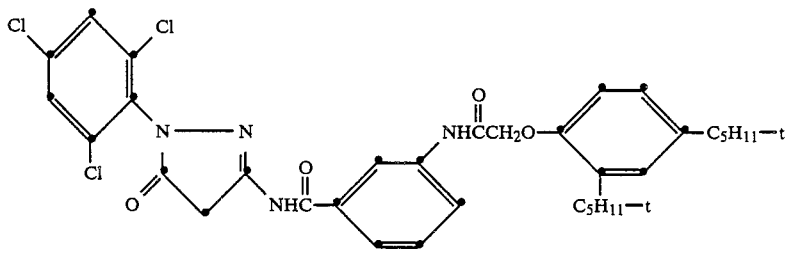

For comparison an identical element was prepared, except except the dye layer contained a prior art yellow filter dye of the formula:

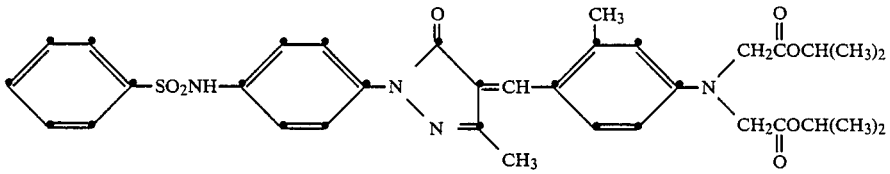

at a level of 16 mg/ft$^2$ instead of dye 7 and dibutyl phthalate at a level of 32 mg/ft$^2$ instead of the tricresyl phosphates.

To determine the spectral absorption of the dyes, sample coatings were placed in a fixing bath for one minute, washed, and dried, then the spectral absorbances were measured. The $\lambda$-max for dye 7 was 432 nm with a bandwidth of 75 nm and a D-max of 1.31. The $\lambda$-max for the comparison dye was 434 nm with a bandwidth of 106 nm and a D-max of 0.70.

The elements were exposed using a sensitometer and processed using Kodak E-6® processing, which is described in *British Journal of Photography Annual*, 1977, pp. 194–97. The level of stain was determined by measuring status M blue densities for the processed elements versus that of the support alone. The status M blue density for the element containing dye 7 was 0.03 whereas the status M blue density for the element containing the comparison dye was 0.09. Thus, the element of the invention exhibited significantly reduced stain.

Stain was also measured by placing fixed samples of unexposed elements in Kodak E-6® developer at 38° C. for 6 minutes and then for 1 minute in a 1% $CH_2O$ solution. After washing and drying, the element containing the comparison dye showed a D-max at 457 nm of 0.14 whereas the element containing dye 7 showed a D-max at 428 nm of 0.04, exhibiting significantly reduced stain.

EXAMPLES 2–6

Spectral Absorption and Bleachability

Dyes according to the invention were coated on supports as dispersions in gelatin and their spectral absorbance was recorded. The elements were then processed for 6 minutes in each of the two Kodak E-6® developers at 38° C., followed by 1 minute in a 1% $CH_2O$ solution, after which spectral absorbance was recorded again. The results are reported in Table I.

| Example | Dye, | level (mg/ft²) | Level of Dispersing Aid 1 (mg/ft²) | Level of Dispersing Aid 2 (mg/ft²) | λ-max (nm) | Bandwidth (nm) | D-max (visible) Before Processing | D-max (visible) After Processing |
|---|---|---|---|---|---|---|---|---|
| 2 | 4, | 9 | 9 | 9 | 439 | 77 | 0.65 | 0.02 |
| 3 | 7, | 13 | 13 | 13 | 436 | 78 | 0.69 | 0.01 |
| 4 | 9, | 13 | 52 | 0 | 467 | 84 | 0.67 | 0.00 |
| 5 | 3, | 9 | 90 | 0 | 417 | 79 | 0.55 | 0.01 |
| 6 | 8, | 15 | 15 | 0 | 441 | 81 | 0.61 | 0.01 |

Dispersing Aid 1

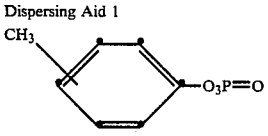

(tricresyl phosphates)

Dispersing Aid 2

$n\text{-}C_{11}H_{23}\overset{O}{\overset{\|}{C}}N(C_2H_5)_2$

The results in Table I indicate that the dyes accordig to the invention effectively absorb yellow light, do not cause stain, and allow the elements to be decolorized ion during photographic processing.

This invention has been described in detail with particular reference to preferred embodiments thereof. It should be understood, however, that variatons and modifications can be made within the spirit and scope of the invention.

What is claimed is:

1. A photographic element comprising a support having thereon a radiation-sensitive silver halide emulsion layer and another layer comprising a hydrophilic colloid binder and from about 0.01 to 1 g/m² of a dye capable of absorbing blue light that would expose said silver halide, said dye having the formula:

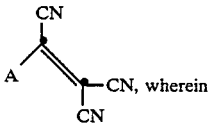

A is a pyrrole or indole nucleus, with the tricyanovinyl radical occupying the 2 or 3 position of the nucleus.

2. A photographic element according to claim 1 wherein the dye is of the formula:

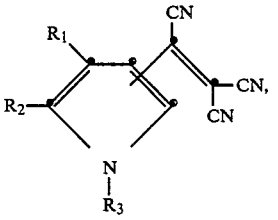

wherein $R_1$ and $R_2$ each independently represents H, alkyl or substituted alkyl of from 1 to 20 carbon atoms, or aryl or substituted aryl of from 6 to 20 carbon atoms, or together represent the atoms necessary to complete 6-membered ring, and $R_3$ is H, alkyl or substituted alkyl of from 1 to 20 carbon atoms, or aryl or substituted aryl of from 6 to 20 carbon atoms.

3. A photographic element according to claim 2 wherein $R_3$ is selected from the group consisting of sulfonamide-substituted alkyl of from 1 to 20 carbon atoms and sulfonamide-substituted aryl of from 6 to 20 carbon atoms.

4. A photographic element comprising a support having thereon a radiation-sensitive silver halide emulsion layer comprising a hydrophilic colloid binder and from about 0.01 to 1 g/m² of a dye capable of absorbing blue light that would expose said silver halide, said dye having the formula

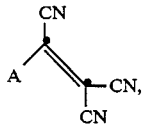

wherein A is a pyrrole or indole nucleus, with the tricyanovinyl radical occupying the 2 or 3 position of the nucleus.

5. A photographic element according to claim 4 wherein the dye is of the formula:

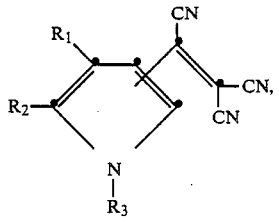

wherein $R_1$ and $R_2$ each independently represents H, alkyl or substituted alkyl of from 1 to 20 carbon atoms, or aryl or substituted aryl of from 6 to 20 carbon atoms, or together represent the atoms necessary to complete 6-membered ring, and $R_3$ is H, alkyl or substituted alkyl of from 1 to 20 carbon atoms, or aryl or substituted aryl of from 6 to 20 carbon atoms.

6. A photographic element according to claim 5 wherein $R_3$ is selected from the group consisting of sulfonamide-substituted alkyl of from 1 to 20 carbon atoms and sulfonamide-substituted aryl of from 6 to 20 carbon atoms.

7. A photographic element according to claim 4 wherein the radiation-sensitive layer comprises radiation-sensitive silver halide.

* * * * *